US011980802B2

(12) United States Patent
Grant et al.

(10) Patent No.: US 11,980,802 B2
(45) Date of Patent: May 14, 2024

(54) WALL MODULE FOR A MODULAR WALL

(71) Applicants: Kenneth J. Grant, Lovell, WY (US); Shane A. Hatch, Orem, UT (US)

(72) Inventors: Kenneth J. Grant, Lovell, WY (US); Shane A. Hatch, Orem, UT (US)

(73) Assignees: Kenneth J. Grant, Lovell, WY (US); Shane A. Hatch, Orem, UT (US)

( * ) Notice: Subject to any disclaimer, the term of this patent is extended or adjusted under 35 U.S.C. 154(b) by 128 days.

(21) Appl. No.: 17/248,971

(22) Filed: Feb. 16, 2021

(65) Prior Publication Data

US 2022/0258025 A1 Aug. 18, 2022

(51) Int. Cl.

| | |
|---|---|
| ***A63B 71/02*** | (2006.01) |
| ***A63B 5/11*** | (2006.01) |
| ***E04B 1/32*** | (2006.01) |
| ***E04B 2/02*** | (2006.01) |

(52) U.S. Cl.

CPC ..... *A63B 71/022* (2013.01); *A63B 5/11* (2013.01); *E04B 1/3205* (2013.01); *E04B 2001/3276* (2013.01); *E04B 2002/0265* (2013.01)

(58) Field of Classification Search

CPC ..... A63B 71/022; A63B 5/11; E04B 1/3205; E04B 2002/0265; E04B 2001/3276; E04H 4/0043

USPC ..... 52/457, 458, 581, 588.1, 582.1, 585.1, 52/589.1, 592.1, 590.1

See application file for complete search history.

(56) References Cited

U.S. PATENT DOCUMENTS

| | | | | |
|---|---|---|---|---|
| 5,735,090 | A * | 4/1998 | Papke | E04C 2/22 52/406.1 |
| 6,216,410 | B1 | 4/2001 | Haberman | |
| 7,691,032 | B2 | 4/2010 | Burnham et al. | |
| 7,966,786 | B2 * | 6/2011 | Koteskey | E02D 29/121 220/4.04 |
| 8,997,436 | B2 | 4/2015 | Spear | |
| 9,366,030 | B2 | 6/2016 | Spear | |
| 9,670,669 | B2 | 6/2017 | Gosling et al. | |
| 10,039,945 | B2 | 8/2018 | Chen | |
| 10,669,711 | B2 | 6/2020 | Parshad | |
| 11,479,982 | B2 * | 10/2022 | Forrester | E04G 13/00 |
| 2005/0054485 | A1 * | 3/2005 | McDermott | A63B 71/0054 482/27 |

(Continued)

FOREIGN PATENT DOCUMENTS

| | | | |
|---|---|---|---|
| CN | 2612407 | Y | 4/2004 |
| CN | 103706074 | A | 4/2014 |

(Continued)

*Primary Examiner* — Brian D Mattei
*Assistant Examiner* — Omar F Hijaz
(74) *Attorney, Agent, or Firm* — Kunzler Bean & Adamson

(57) ABSTRACT

A wall module for a modular wall having a wall segment with a top, bottom, front, back, first end, and back end. A first component of a connector is preferably and extended tongue and is attached to the second end of a wall segment. The second component of a connector is preferably an extended groove in the first end of the wall segment. Preferably, a channel exists along the length of each wall segment at top. Also, preferably either a ring segment or an elongate member is in such channel and is connected to a leg. And preferably the ring segment or elongate member connects to the corresponding element on an adjacent wall segment when such adjacent wall segment has been connected to the first wall segment.

20 Claims, 19 Drawing Sheets

(56) References Cited

U.S. PATENT DOCUMENTS

| | | | | |
|---|---|---|---|---|
| 2010/0236182 | A1* | 9/2010 | Mackenzie | E04F 19/00 52/834 |
| 2017/0333741 | A1* | 11/2017 | Chen | A63B 71/023 |
| 2022/0241662 | A1* | 8/2022 | Burk | A63B 71/0036 |

FOREIGN PATENT DOCUMENTS

| | | | |
|---|---|---|---|
| CN | 204319609 | U | 5/2015 |
| CN | 108905042 | A | 11/2018 |
| CN | 208641630 | U | 3/2019 |
| CN | 109555336 | A | 4/2019 |
| DE | 9307131 | U1 | 7/1993 |
| DE | 202008015422 | U1 | 2/2009 |
| DE | 202014104396 | U1 | 12/2015 |
| EP | 3360606 | A1 | 8/2018 |
| KR | 20160073522 | A | 6/2016 |
| KR | 102155243 | B1 | 9/2020 |
| NL | 2018164 | B1 | 7/2018 |

* cited by examiner

WALL MODULE FOR A MODULAR WALL

BACKGROUND OF THE INVENTION

Field of the Invention

This invention relates to a wall module for a modular wall, especially a modular wall associated with a trampoline.

Description of the Related Art

Numerous patents and advertised products exist concerning walls for trampolines.

Relevant patent-related documents include United States patent publication no. 2005054485 for a now abandoned patent application; U.S. Pat. No. 7,691,032; Korean patent no. 102155243; Netherlands patent no. 2018164; Chinese patent no. 208641630; German lapsed utility model no. 202008015422; Chinese patent no. 108905042; European patent application no. 3360606, which has been deemed withdrawn; Korean patent no. 20160073522; U.S. Pat. No. 7,718,764; German utility model no. 202014104396; Chinese patent no. 204319609; German lapsed utility model 9307131; Chinese patent application no. 109555336; U.S. Pat. No. 10,039,948; Chinese lapsed utility model no. 2612407; and Chinese patent no. 201310536437.

Related advertised products are viewable on the Internet at the following url addresses: https://trampolinesdownunder.com for Trampolines Down Under, www.trampolinesinground.com for Avyna, http://protrampolines.com/rectangular-trampolines/in-ground-trampoline-jump-power/#gref for Pro Trampolines, http://www.capitalplay.com/products/14ft-x-10ft-in-ground-trampoline-kits for Capitalplay, and https://www.trampolines.com/collections/inground-trampoline-kits for Trampolines.com.

None of the patent-related documents or the products viewable at the preceding url addresses, however, include wall modules with wall segments having fasteners where the components of the fasteners comprise components selected from the group consisting of a projection and a mating aperture where the projection is an elongate projection in at least two—but, preferably, three—directions such as an extended tongue of a tongue and groove connector and where the mating aperture is an elongate aperture in at least two—but, preferably, three-directions such as an extended—groove of a tongue and groove connector. No channel exists along the length of each wall segment in these documents and products, especially a channel to accommodate a segment of a ring for a trampoline. These documents and products also seem to lack an air vent in each wall segment, especially an air vent which is a transverse depression in a channel of the wall segment. Additionally, none of these documents or products has a segment of a trampoline ring in a channel. Moreover, none of these documents or products has a trampoline leg embedded within a wall segment. And each of these documents or products lacks a horizontal ledge extending outward from the top front along the length of a wall segment to serve as a support, designated a mow strip, for a lawnmower or trimmer to care for grass adjacent to the wall segment without damaging any portion of the trampoline.

It, furthermore, appears that the wall associated with each of these documents or products would require considerably more than four minutes to install.

On initial appearance several patent documents appear to have a mow edge associated with a wall for a trampoline, but more careful analysis discloses that this is not the case.

German lapsed utility model no. DE 202008015422 appeared in drawings possibly to have a mow edge as element 8, but paragraph 41 explained [using the machine translation provided by the Espacenet patent search service of the European Patent Office]: "The fall protection elements 8 are fixed to the tops of the covers 3c, preferably by means of adhesive. The fall protection element 8 consist [sic] of non-slip and at the same time shock-absorbing materials, such as, for example, recycling materials that are made from old rubber tires. The fall protection elements 8 thus form an impact protection and at the same time protection against slipping by the use of the trampline 1."

Chinese patent no. 108905042 similarly appeared in drawings possibly to have a mow edge as element 3, but paragraph 40 clarified [using the machine translation provided by the Espacenet patent search service of the European Patent Office]: "The invention provides a bounce training device for sports training, including a cylinder 1, a countersunk [sic] through hole 101, a weighted round block 2, a circular groove 201, a threaded hole 202, a first anti-slip cushion 3, and a first circular hole 30 [sic]"

Likewise, Korean patent no. KR 20160073522 has an element appearing in drawings possibly to be a mow edge, but paragraph 36 shows [using the machine translation provided by the Espacenet patent search service of the European Patent Office] this is not the case: "The second mat 60 is installed on the ground 200 so as to be connected to the first mat 50, so that even if a user of the underground trampoline 100 bounces out of the underground trampoline 100 during a jump movement, the second mat An [sic] accident can be prevented by landing on the mat 60 so as not to be injured."

And, finally, in this regard the elements no. 15 in drawings of German lapsed utility model no. 9307131 create the erroneous impression that they constitute a mow edge. This lapsed utiity model, in fact, declares in paragraph 51 [using the machine translation provided by the Espacenet patent search service of the European Patent Office], "The jumping net 3 of the trampoline 1 is elastically anchored in the clamping frame 2.1. In order to exclude the risk of injury when using the trampoline 1, direct contact with the clamping frame 2.1 is prevented in a simple and advantageous manner by soft cover plates 15 which form the inner and outer edge of the clamping frame 2.1."

Five United States patents, viz., U.S. Pat. Nos. 6,216,410; 8,997,436; 9,366,030; 9,670,669; and 10,669,711 involve tongue and groove connectors in conjunction with panels for walls but are otherwise dissimilar to the Modular Wall of the present invention.

BRIEF SUMMARY OF THE INVENTION

The present invention employs wall modules having wall segments which adjoin or connect to one another to form, when viewed from above, a wall which is either (1) a closed figure such as a polygon or, preferably, a circle or (2) a wall the ends of which do not join.

Whether viewed from the front (i.e., the portion of the wall segment which faces outward in the version where the wall creates from the closed figure) or back (i.e., the portion of the wall which faces inward when the wall creates a closed figure), the wall segment appears to be a rectangle. When viewed from the top or the bottom, the wall segments are elongate objects which, though, preferably appear to be an arc of a circle but optionally appear to be a rectangle.

Near or on each end a wall segment has a component of a connector so that multiple wall segments can be connected to form the closed figure or wall the ends of which are not joined, although when the ends of the wall are not joined, the first end of the first wall segment does not require a component of a connector and the second end of the last wall segment does not require a component of a connector. Most preferably the components of the connector are an extended tongue and an extended groove being of such a size as to cause adjacent wall segments to move substantially together in addition to aligning such segments thereby enhancing the stability of a wall formed from such wall segments and maintaining the integrity of such wall.

The connected wall segments form a self-supporting wall, although when the wall is used above ground, rather than below ground such as for a retaining wall for soil surrounding a trampoline which has its jumping mat at ground level, supplemental fasteners are preferably employed.

Preferably, a channel exists along the length of each wall segment at top of the back of the wall segment when such wall segment is intended to be used in conjunction with a trampoline.

Also preferably for a wall segment which is for use in conjunction with a trampoline, the deepest portion of the channel has the same shape as the surface of a trampoline ring.

The channel for use with a trampoline keeps the trampoline in better contact with the wall and thereby reduces the risk of a gap between the trampoline and the wall which could cause an injury to the user of the trampoline.

An air vent preferably exists in each wall segment intended for use with a trampoline, which air vent is preferably a transverse depression across the channel.

Even more preferably, a segment of a trampoline ring is situated in the channel and is, preferably, attached to the top of a leg which is preferably embedded in each such wall segment, although optionally some wall segments do not contain the leg, and which can serve as a trampoline leg. Preferably, adjacent ring segments which are preferably made of metal and which are preferably hollow, are connected to one another. Preferably, this is accomplished having a first end of the ring segment aligned with the first end of the associated wall segment and by having the second end of the ring segment extend beyond the second end of the associated wall segment and, having the diameter of the second end of the ring segment decrease where the ring segment passes the second end of the associated wall segment sufficiently to fit into the first end of the ring segment associated with the next wall segment with no gaps between the adjacent wall segments. [Pgrankmw40.docx]

For a wall segment not intended to be used with a trampoline, there is not necessarily, but preferably, a channel; and, also preferably, an elongate member, which is preferably metal and is also preferably hollow, is connected to the top of each wall segment. Moreover, preferably, the elongate members for each wall segment are connected to each other; also, preferably the adjacent elongate members can be connected simultaneously or nearly simultaneously with the connection of the adjacent wall segments. And the elongate member for each wall segment is, even more preferably, connected to the wall segment by being connected to a leg, which is preferably embedded in the wall segment. Most preferably, the elongate members of adjacent wall segments can be connected with one another simultaneously or nearly simultaneously with the connection of the mating portions of the connectors for the adjacent wall segments.

The wall segments are preferably hollow to decrease their weight but also preferably have inward projections from the interior of the front side touching inward projections from the interior of the back side to increase the strength of the wall segments while maintaining the light weight of the wall segments.

Preferably, the wall segments each have a leg embedded within them to increase stability and structural strength, whether the wall segment is to be used with a trampoline or not. The leg is attached to a ring segment when the wall segment is associated with a trampoline and connected to an elongate member for a wall segment not intended to be used with a trampoline. Other inward projections from the interior of the front side and from the interior of the back side retain the imbedded leg within the wall segment thereby both increasing the strength of the wall segment and maintaining the light weight of the wall segment. Furthermore, as does the channel as described above, the leg keeps a trampoline in better contact with the wall and thereby reduces the risk of a gap between the trampoline and the wall which could cause an injury to the user of the trampoline.

The construction of the Wall Modules as described generally above and more thoroughly below is such that the Modular Wall intended to be used in conjunction with a trampoline can be assembled in three to four minutes and permits nesting of the wall segments, even with an attached segment of a trampoline ring.

One of ordinary skill in the art will, furthermore, recognize that the Modular Wall can be used at or near the edge of virtually any physical structure—including, but not limited to, a container or pool for holding a liquid.

For a wall segment which is intended to be buried in the ground with the top of the wall segment level with the ground, such as for use with a trampoline, a horizontal ledge preferably extends outward from the top front of the wall segment along the length of the wall segment to serve as a support, designated a mow strip, for a lawnmower or trimmer to care for grass adjacent to the wall segment without damaging any portion of the trampoline or any other object near the back of the wall segment. This mow strip, furthermore and even if no grass is adjacent to the Modular Wall reduces the risk of having a potentially dangerous gap between the ground and the wall segment.

DETAILED DESCRIPTION OF THE INVENTION

The Wall Module for a Modular Wall 1 of the present invention comprises a multitude of wall segments 2.

Figure 1:
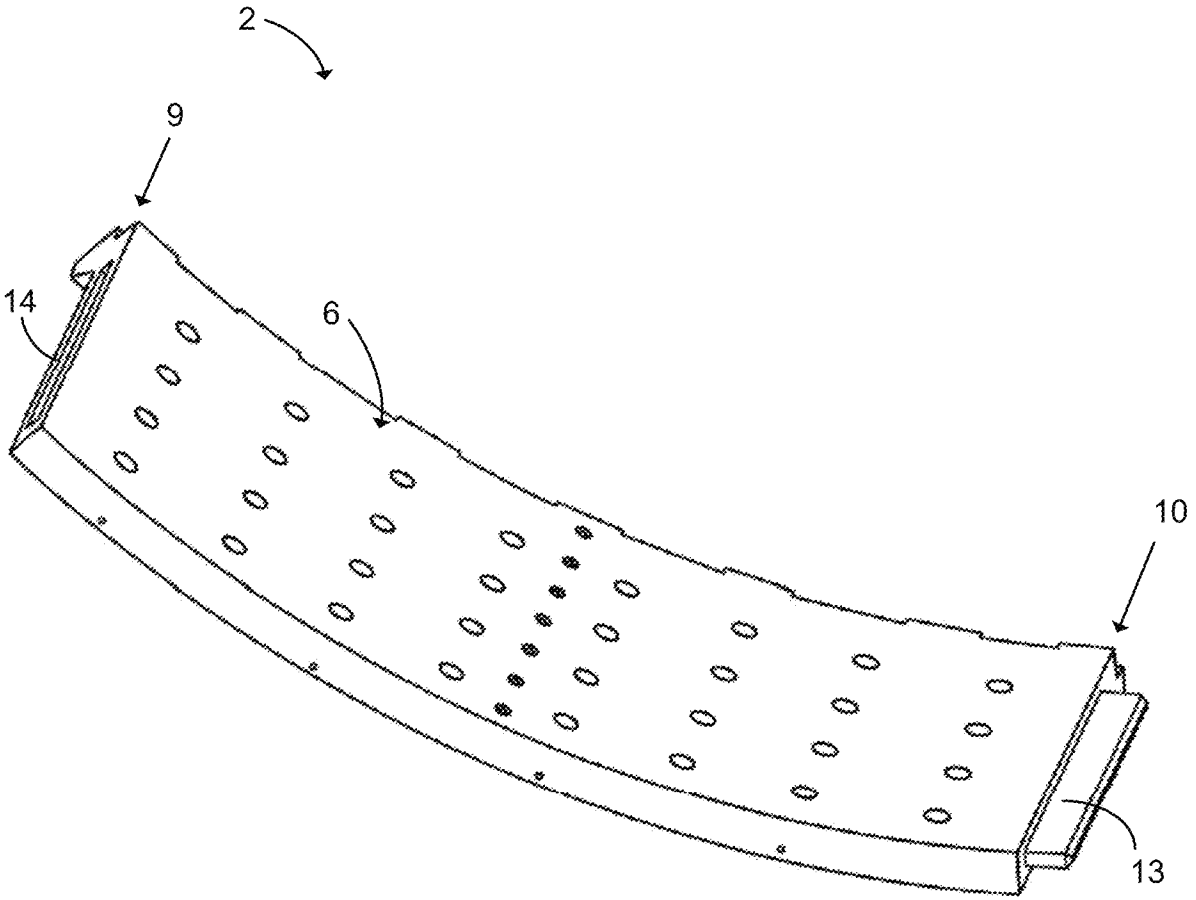
FIG. 1 is a perspective view of a wall segment from the rear and below.
Figure 2:
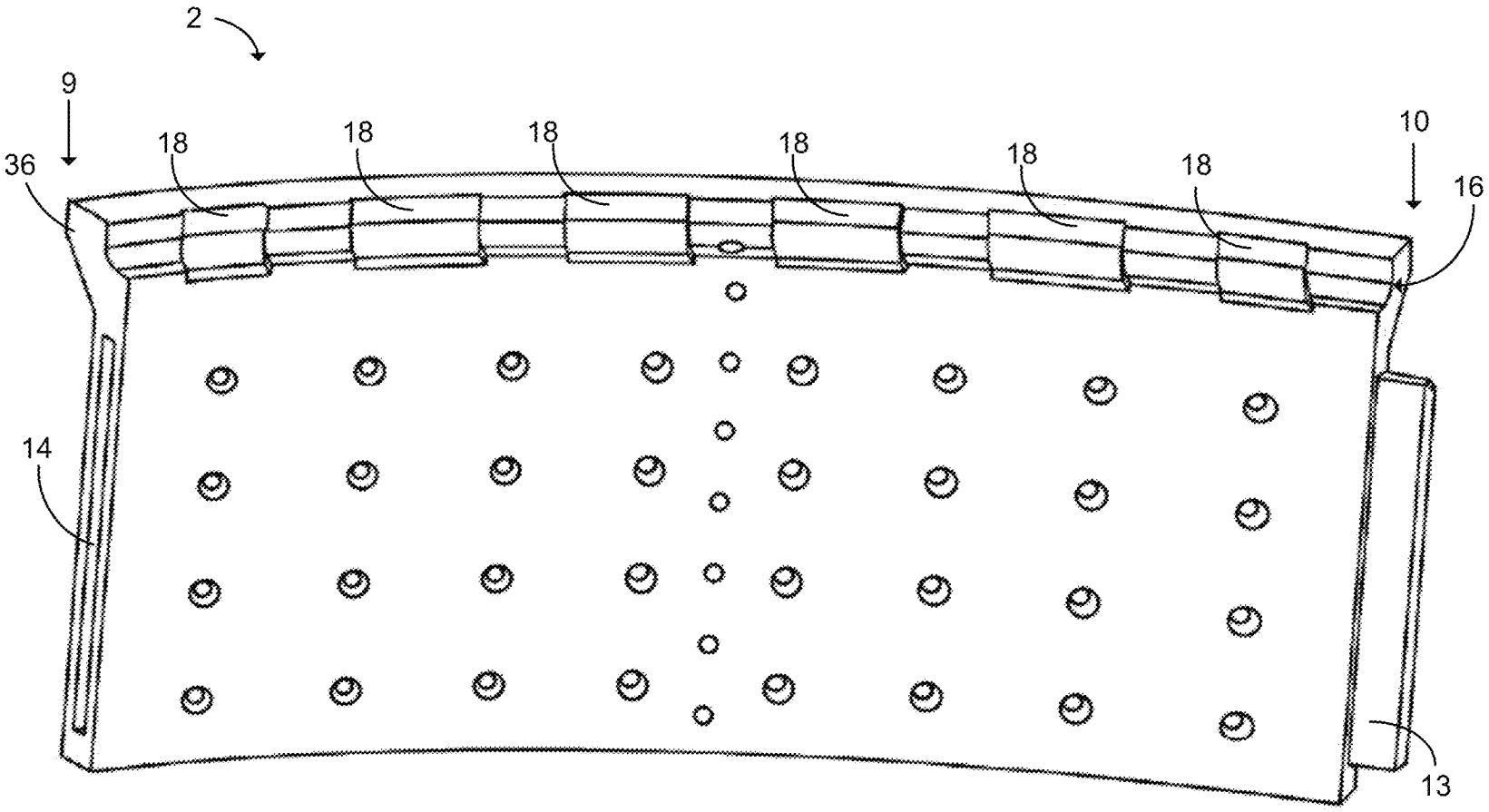
FIG. 2 is an elevation view of a wall segment from the rear.
Figure 3:
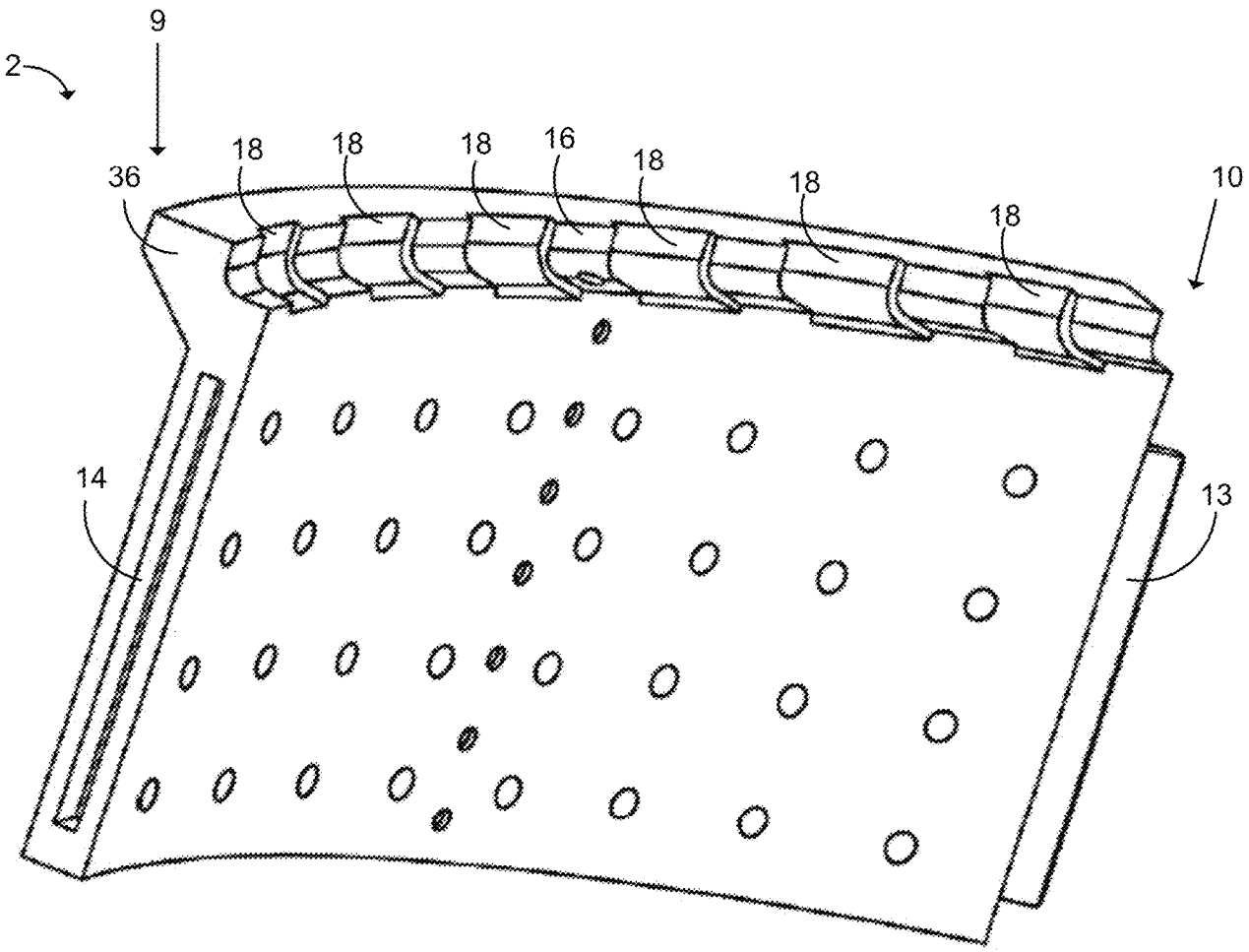
FIG. 3 is a perspective view of a wall segment from the segment's rear and from the viewer's left.
Figure 4:
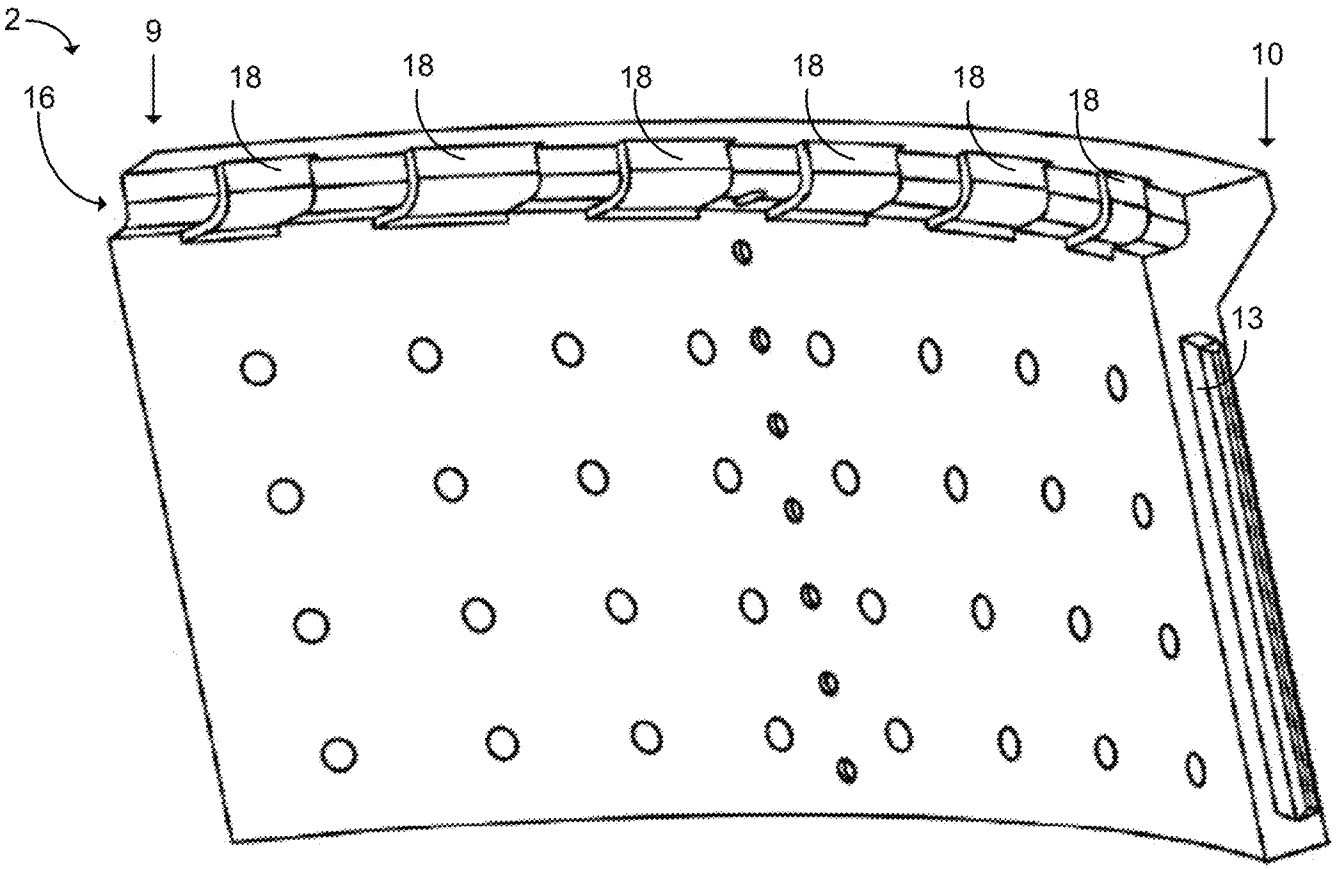
FIG. 4 is a perspective view of a wall segment from the segment's rear and from the viewer's right.
Figure 5:
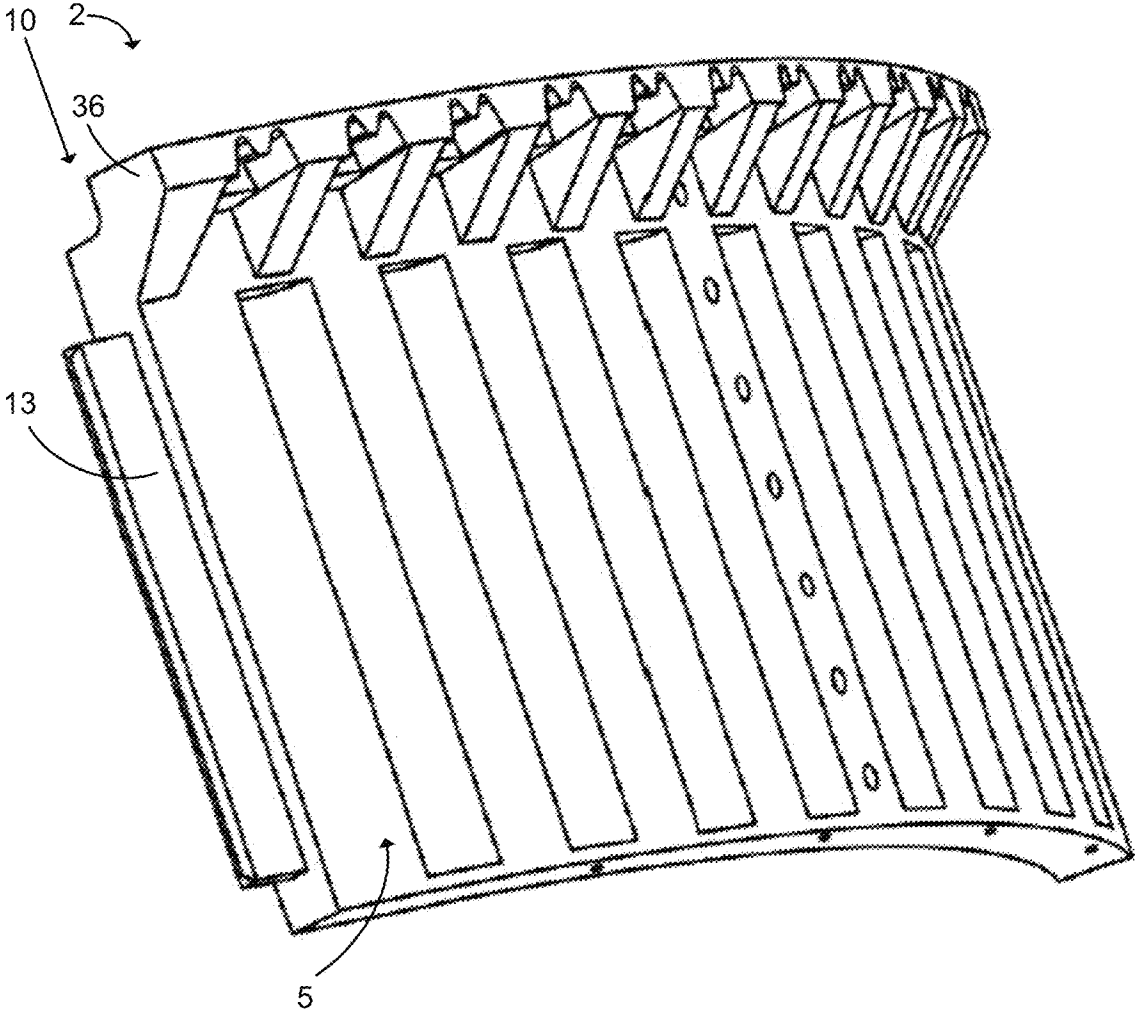
FIG. 5 is a perspective view of a wall segment from the segment's front and from the viewer's left.
Figure 6:
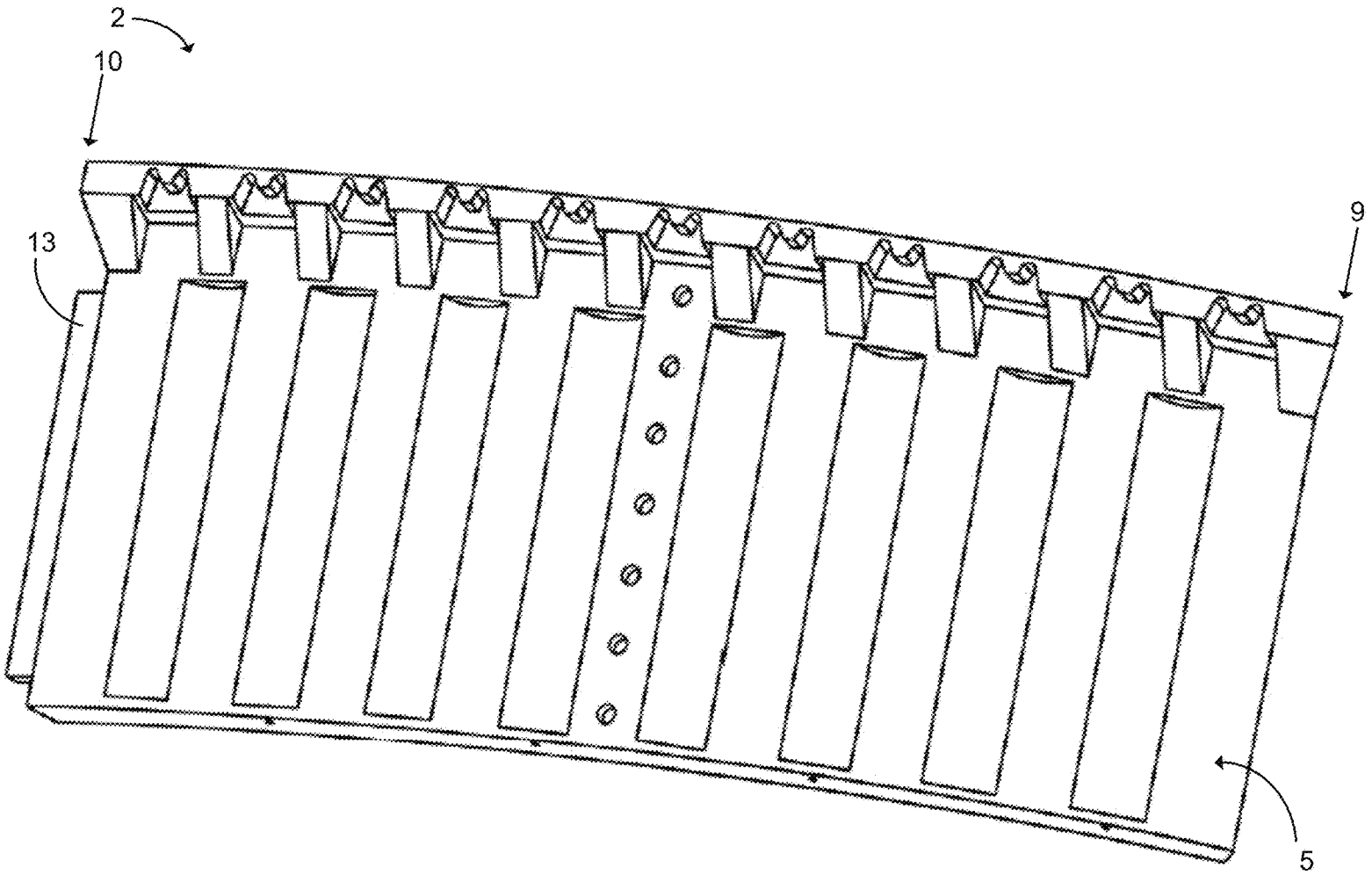
FIG. 6 is a perspective view of a wall segment from the front and below.
Figure 7:
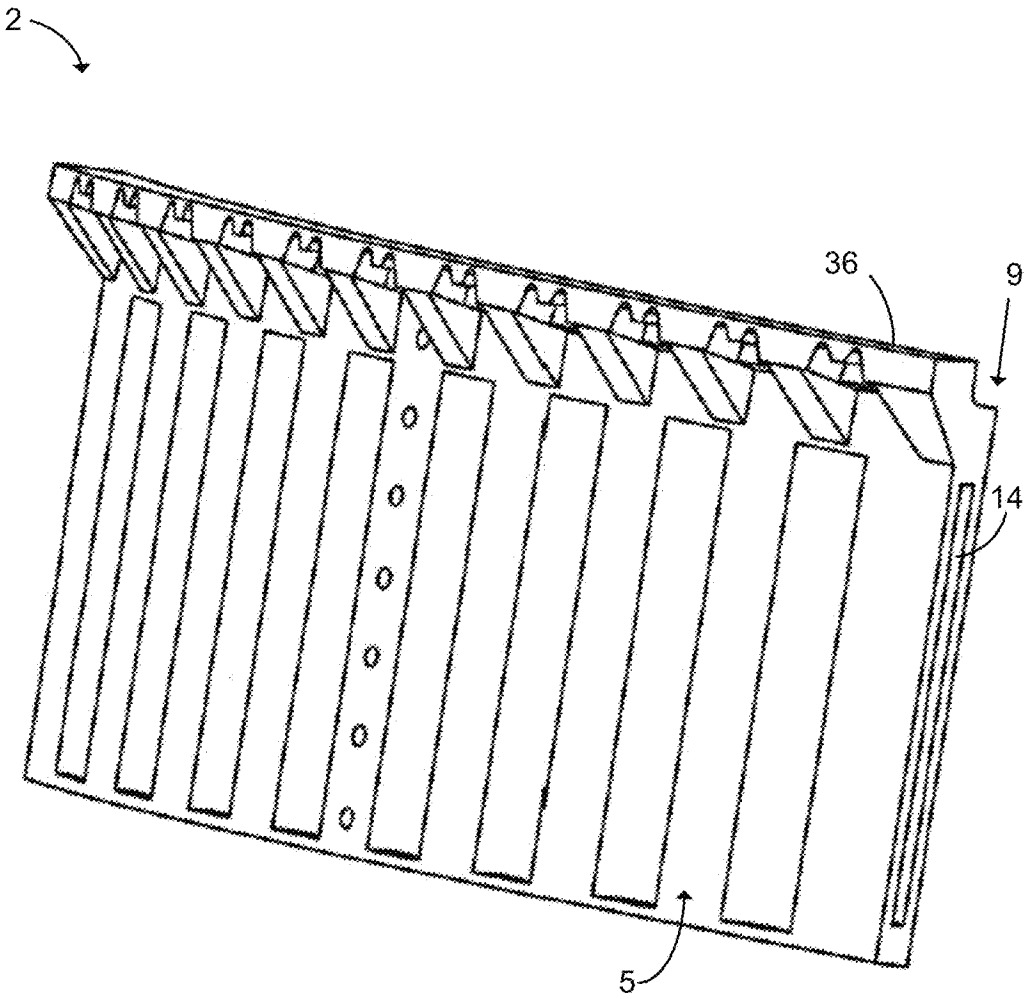
FIG. 7 is a perspective view of a wall segment from the wall segment's front and from the viewer's right.
Figure 8:
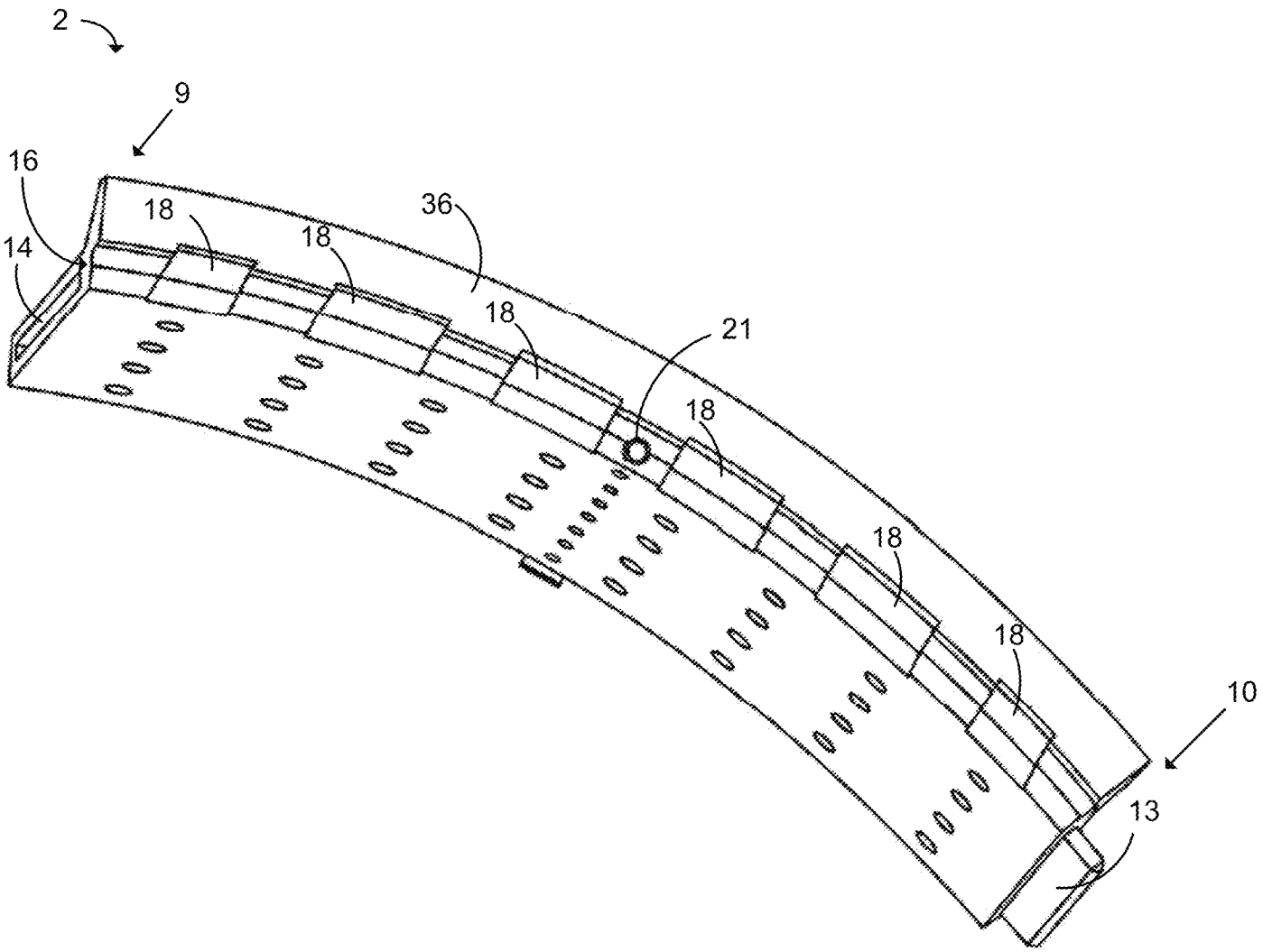
FIG. 8 is a perspective view of a wall segment from the rear and above showing the imbedded leg.
Figure 9:
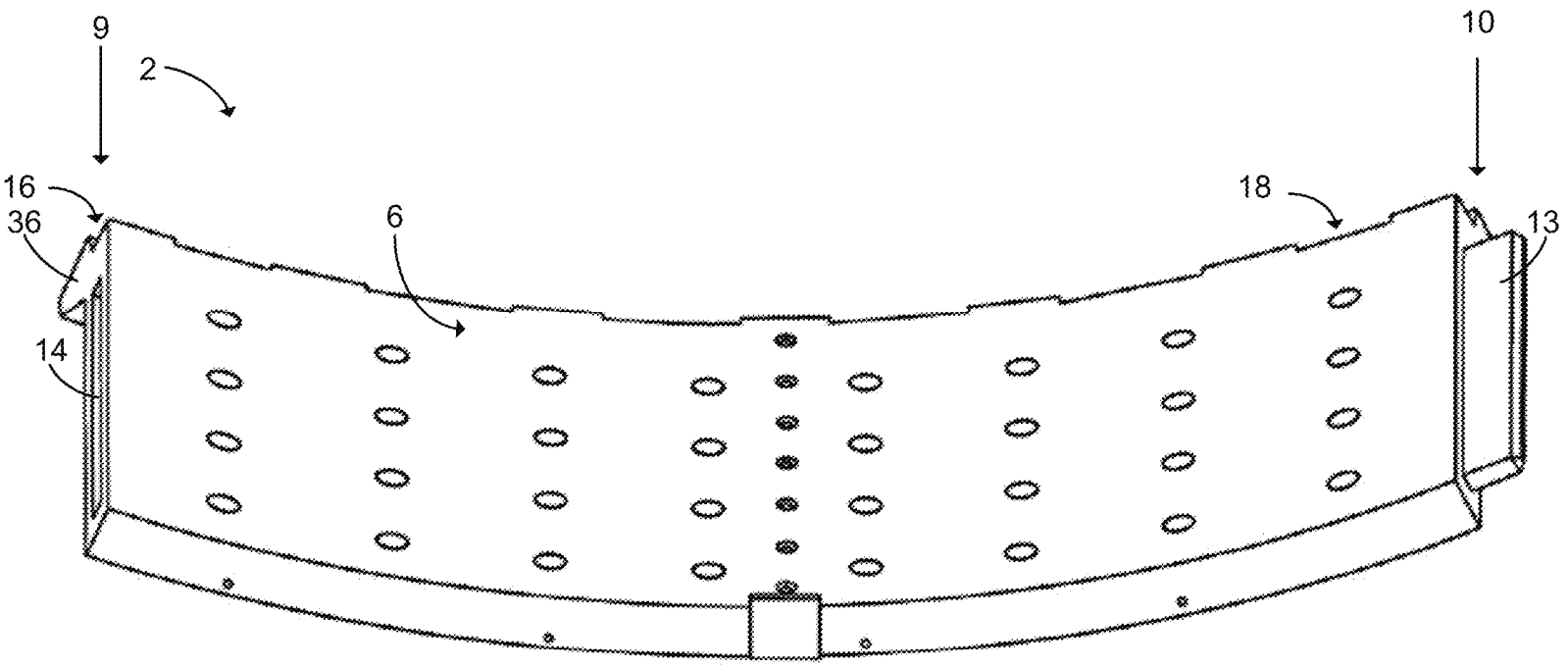
FIG. 9 is a perspective view of a wall segment from the rear and below showing the imbedded leg.
Figure 10:
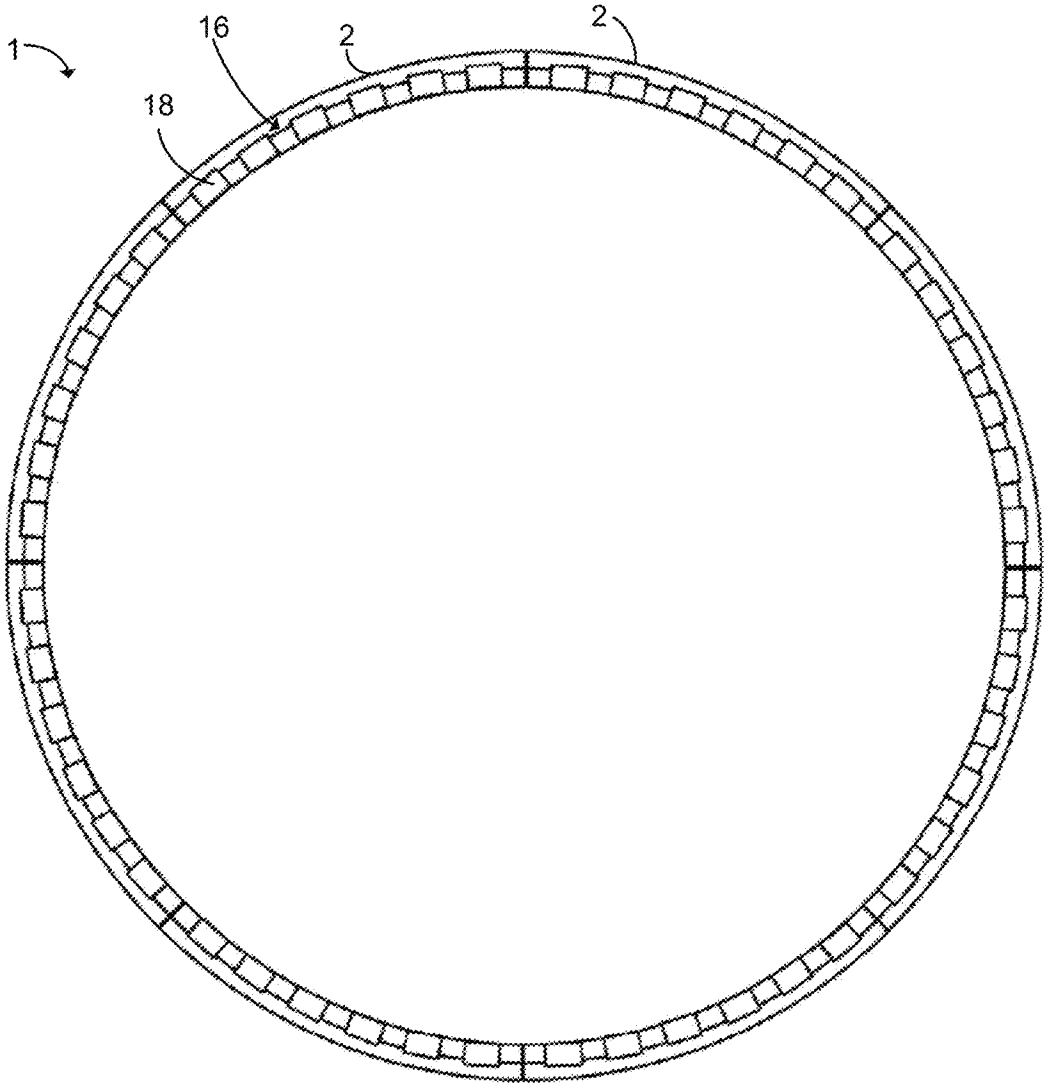
FIG. 10 is a plan view from above of a circular Modular Wall comprising eight Wall Modules.
Figure 11:
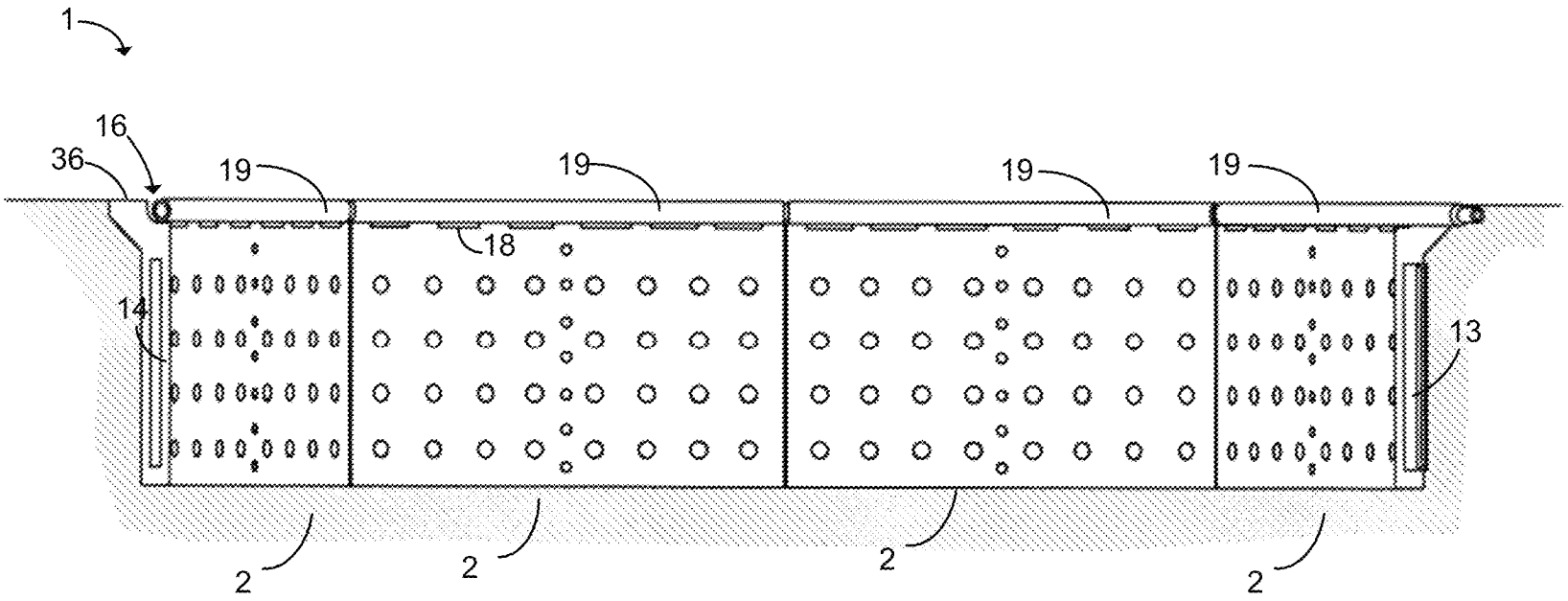
FIG. 11 is a elevation view from the back showing connected Wall Modules having wall segments with ring segments in a channel and also possessing a mow strip.
Figure 12:
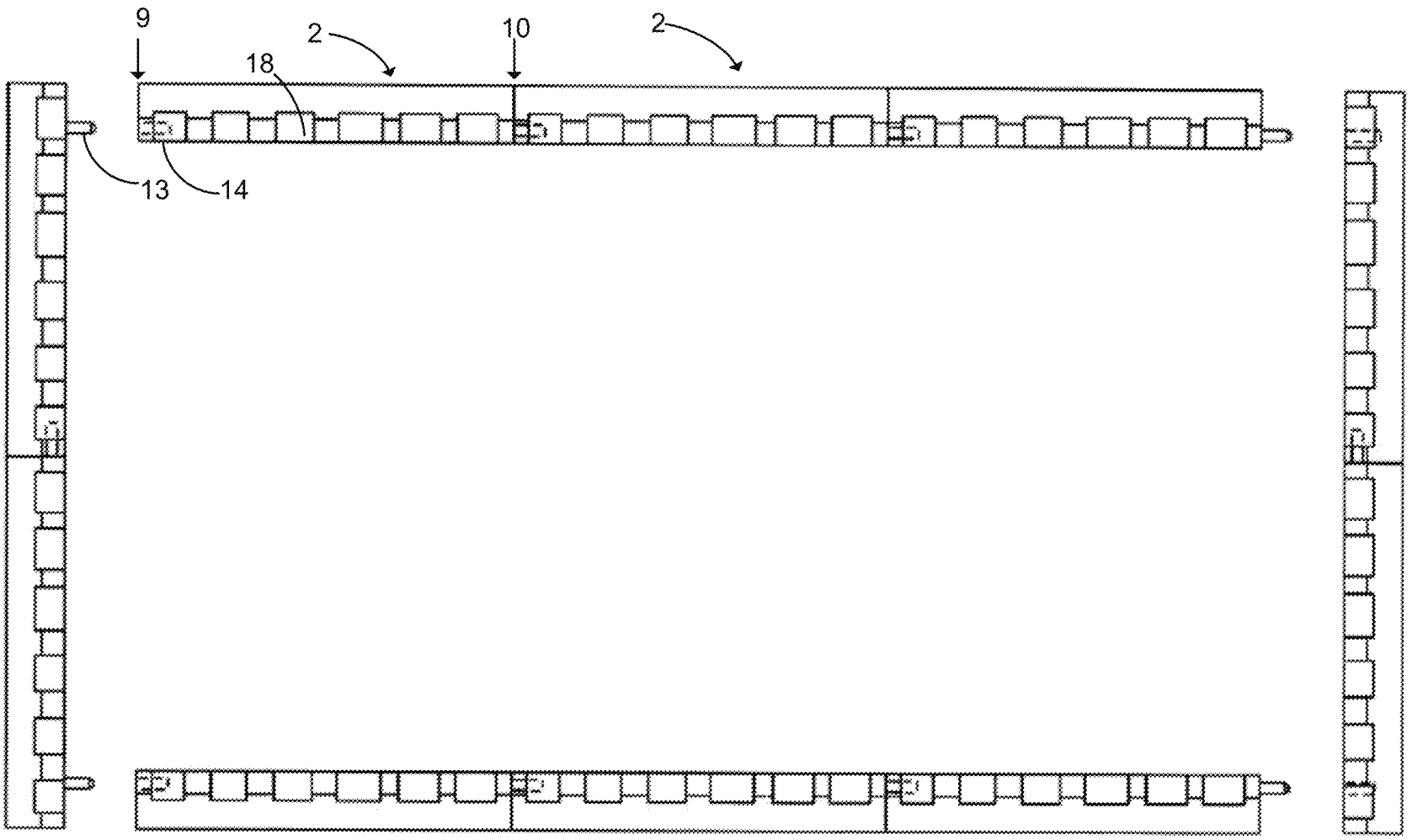
FIG. 12 is a plan view from above showing a rectangular Modular Wall with a first arrangement of connectors.
Figure 13:
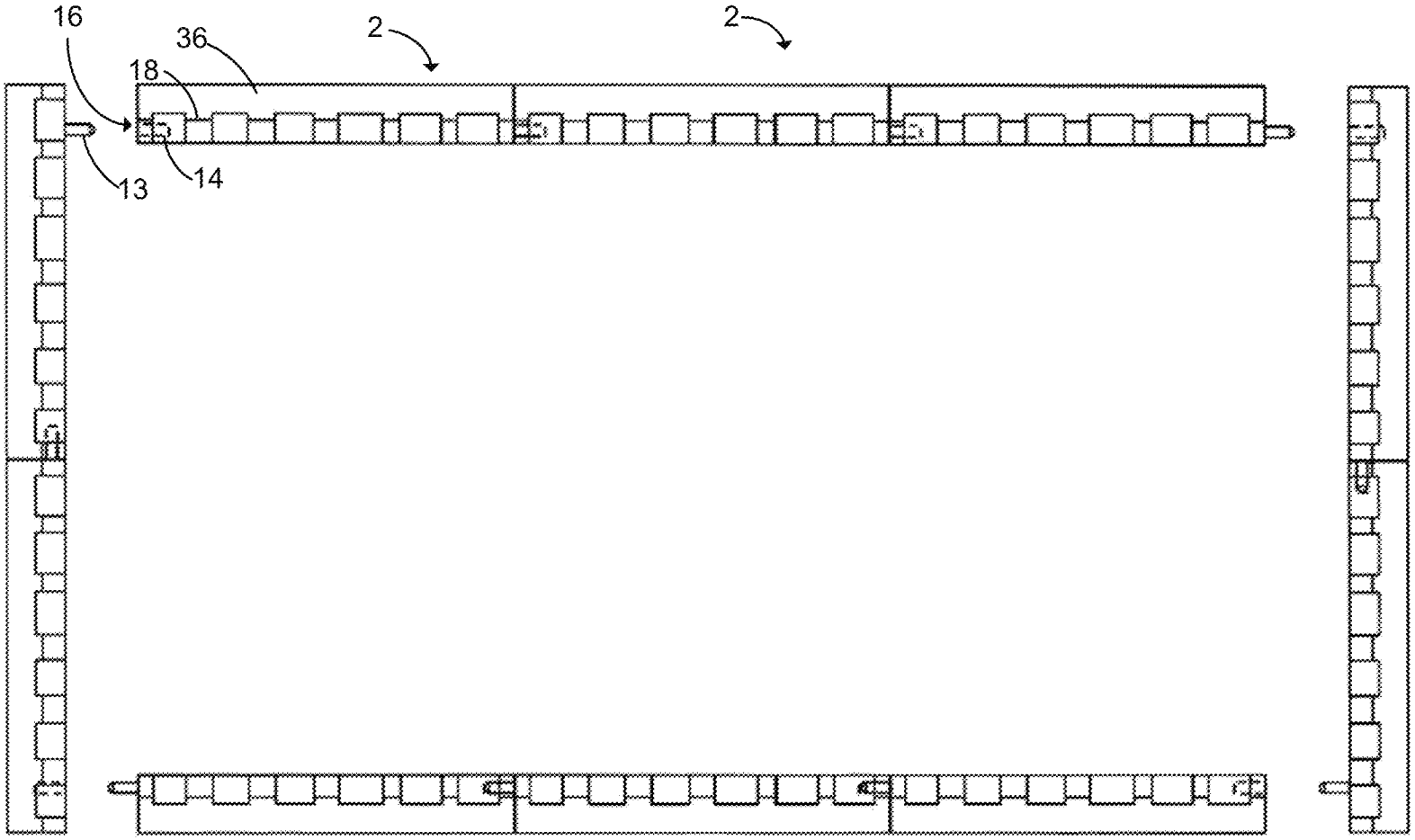
FIG. 13 is a plan view from above showing a rectangular Modular Wall with a second arrangement of connectors.
Figure 14:
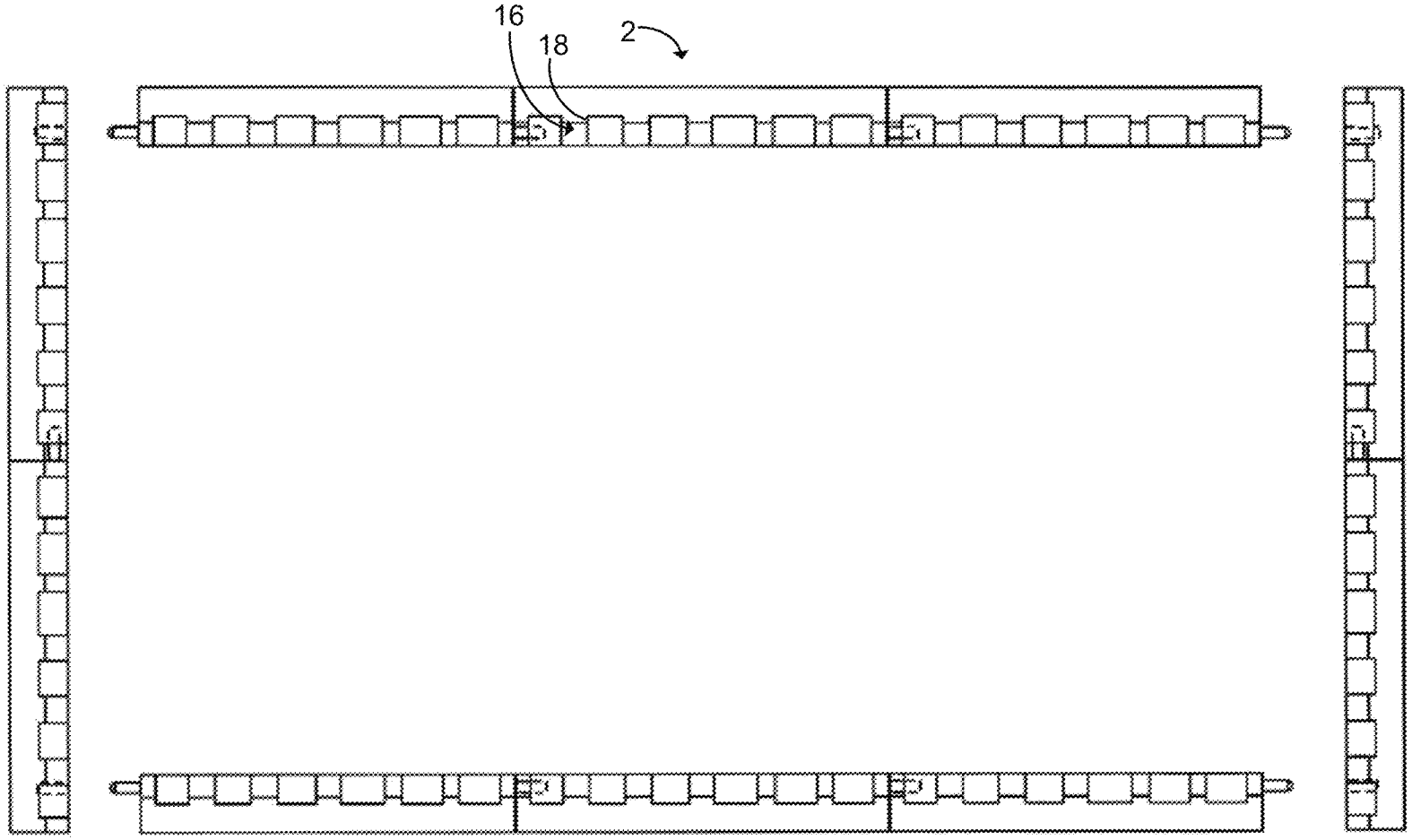
FIG. 14 is a plan view from above showing a rectangular Modular Wall with a third arrangement of connectors.
Figure 15:
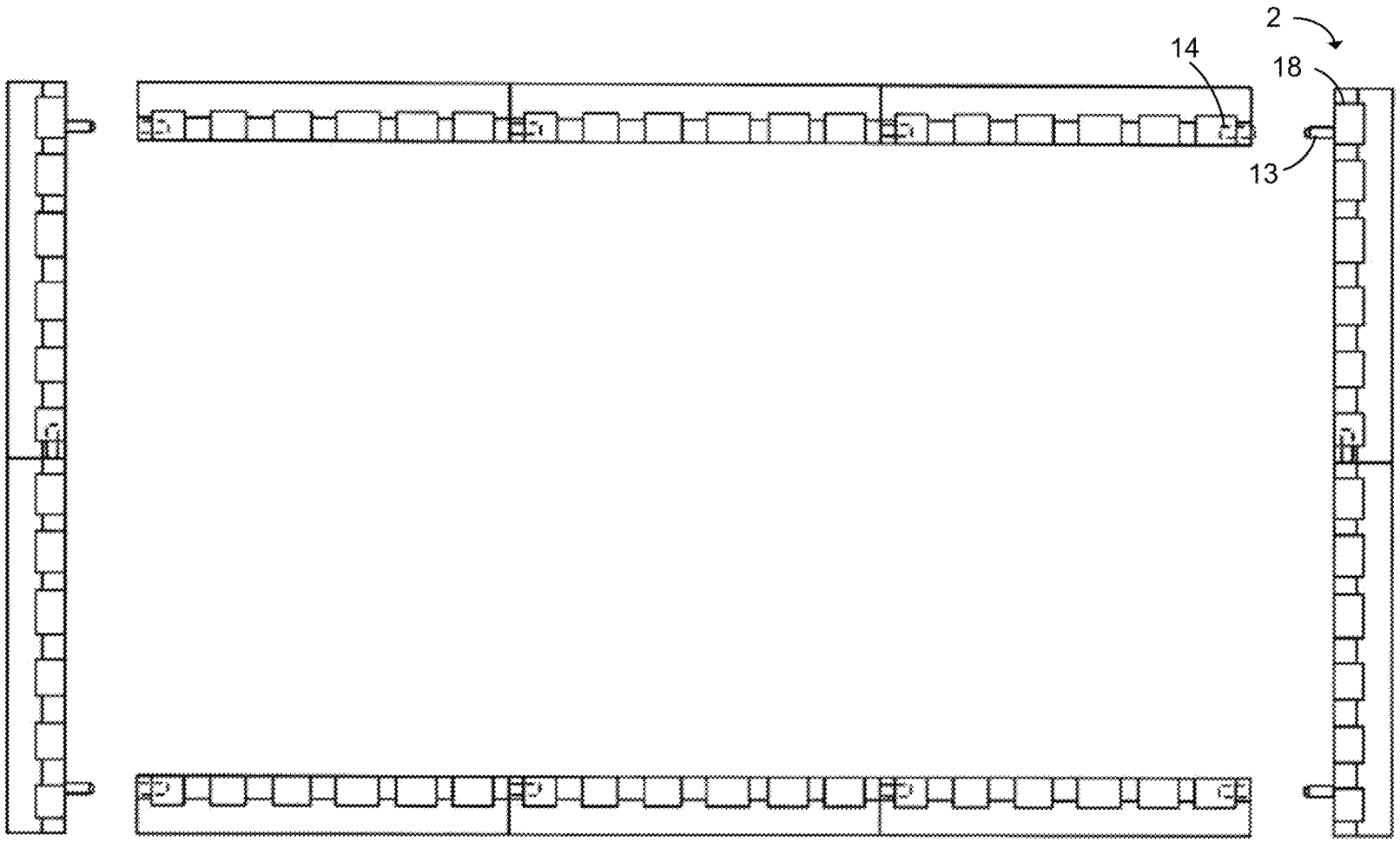
FIG. 15 is a plan view from above showing a rectangular Modular Wall with a fourth arrangement of connectors.
Figure 16:
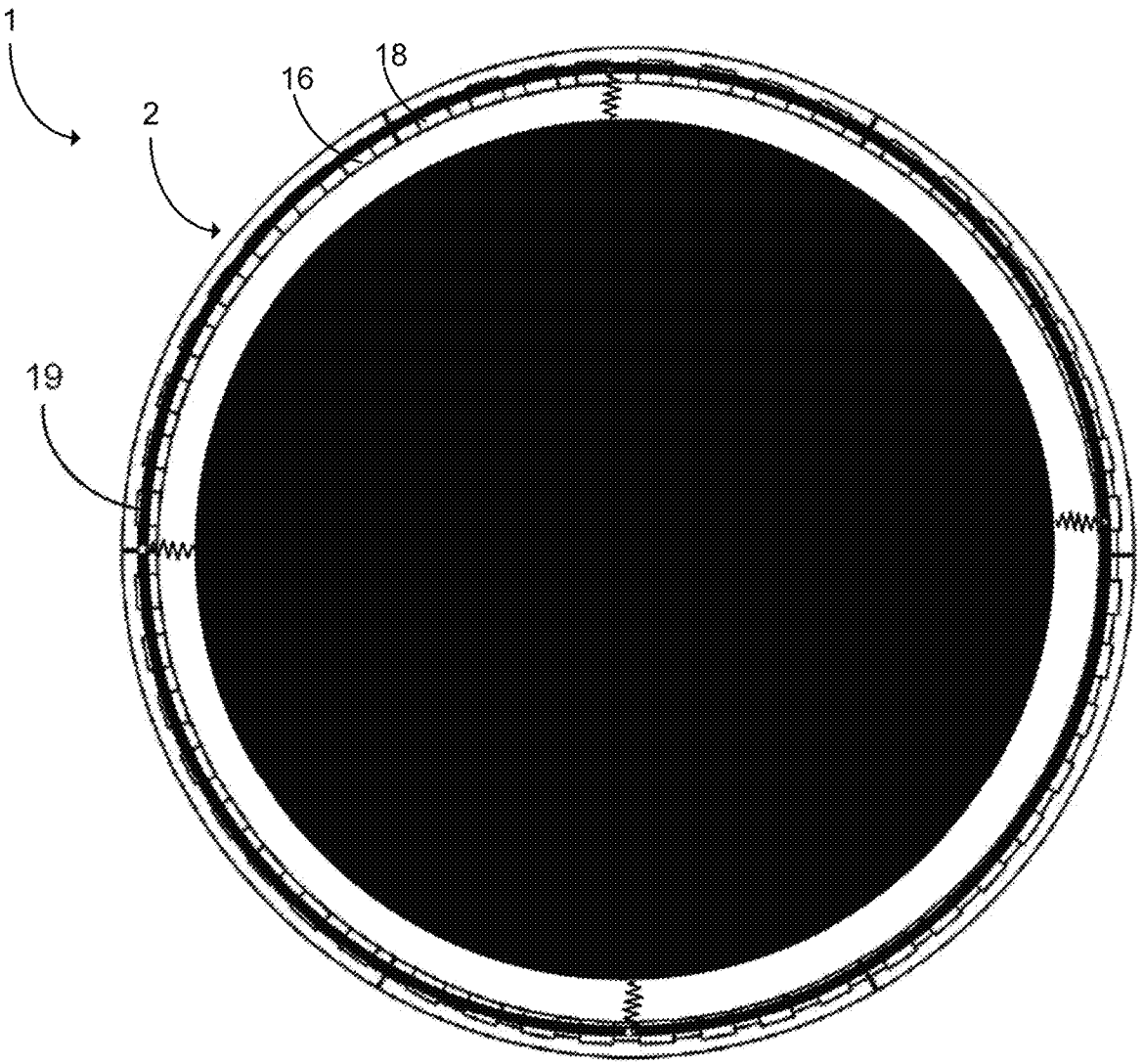
FIG. 16 is a plan view from above of a circular Modular Wall comprising six Wall Modules.
Figure 17:
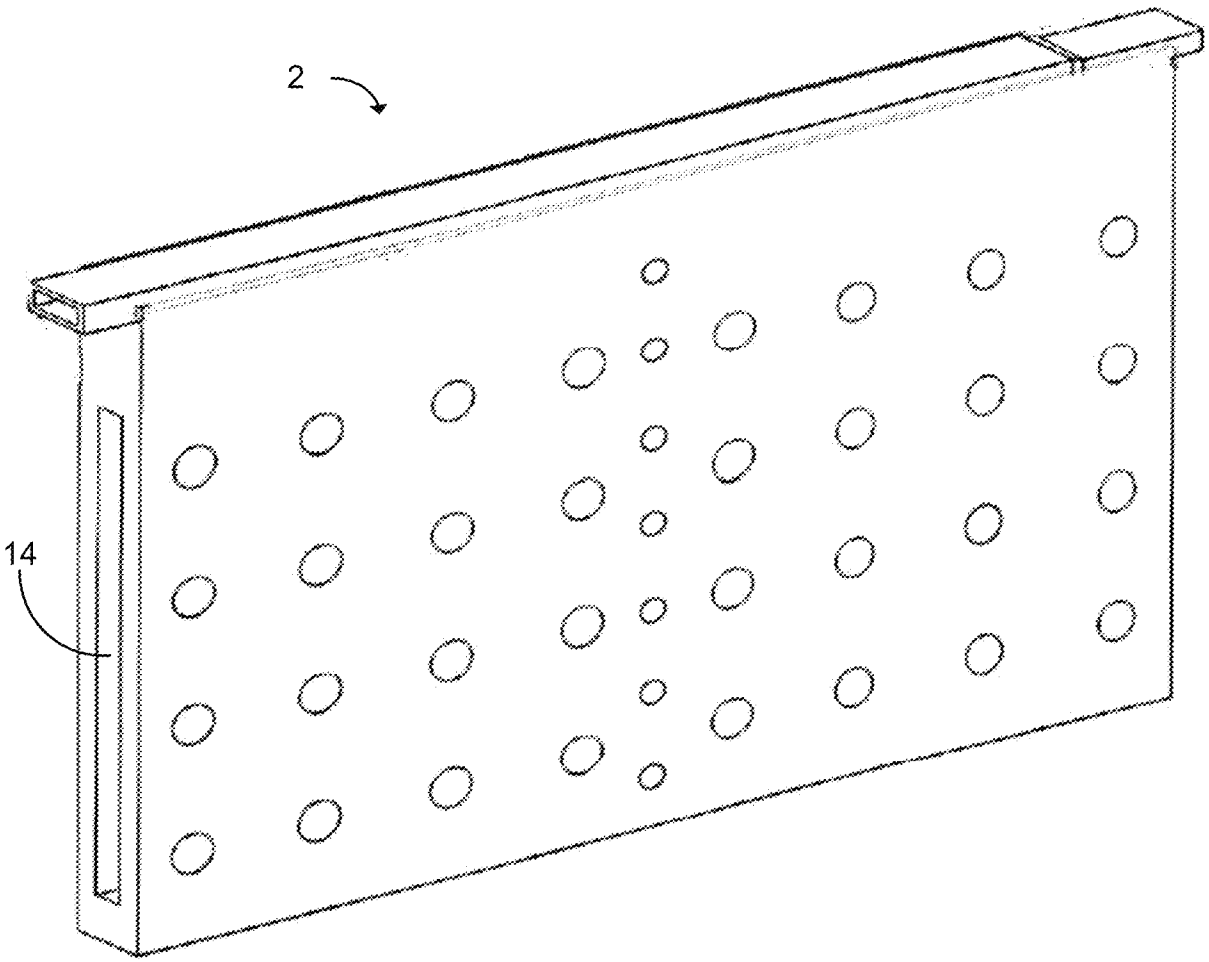
FIG. 17 is a perspective view of a wall segment not associated with a trampoline from the rear and the viewer's left.
Figure 18:
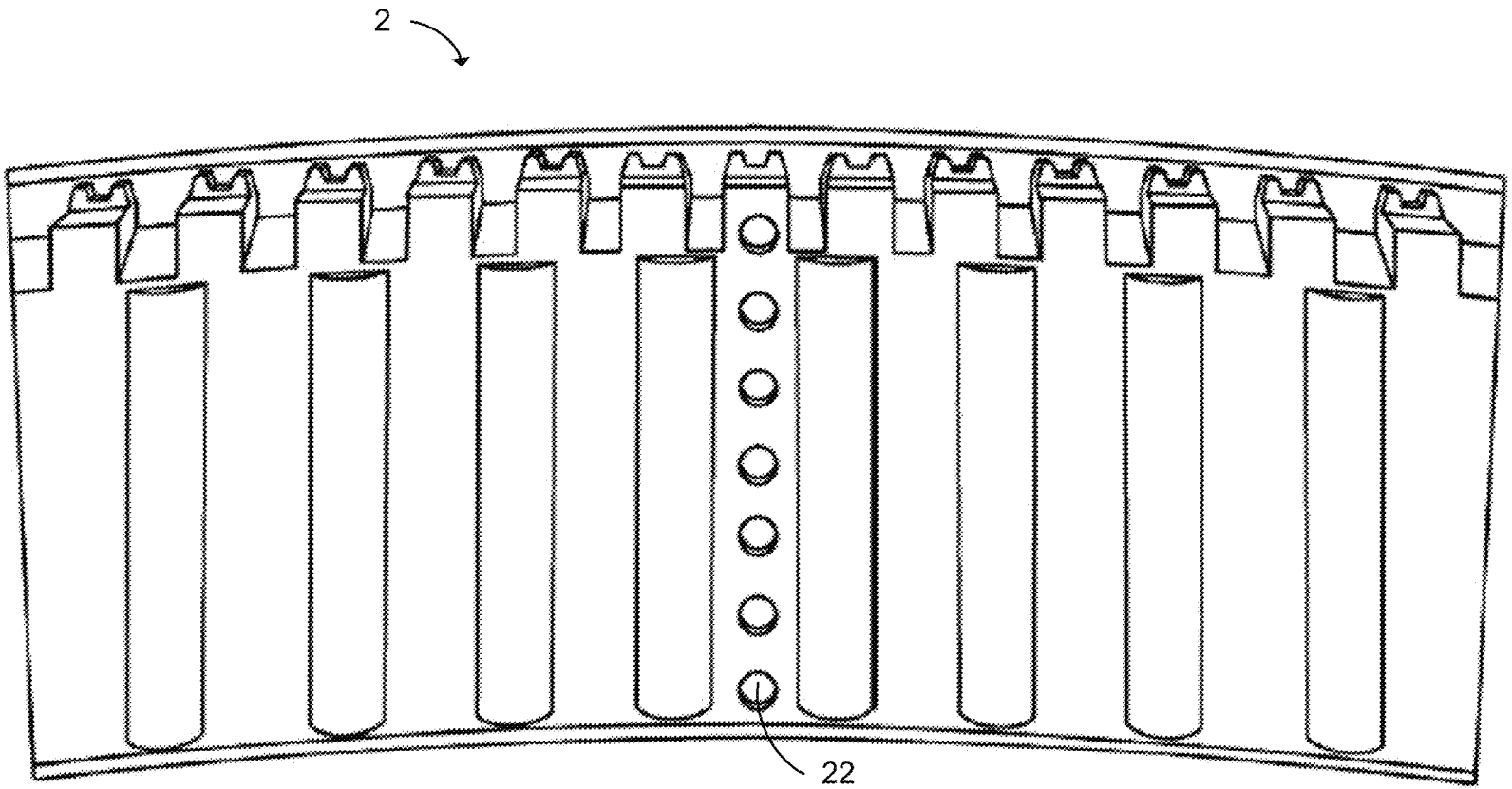
FIG. 18 is an elevation view showing the semi-cylindrical projections on the interior of the back of the wall segment.
Figure 19:
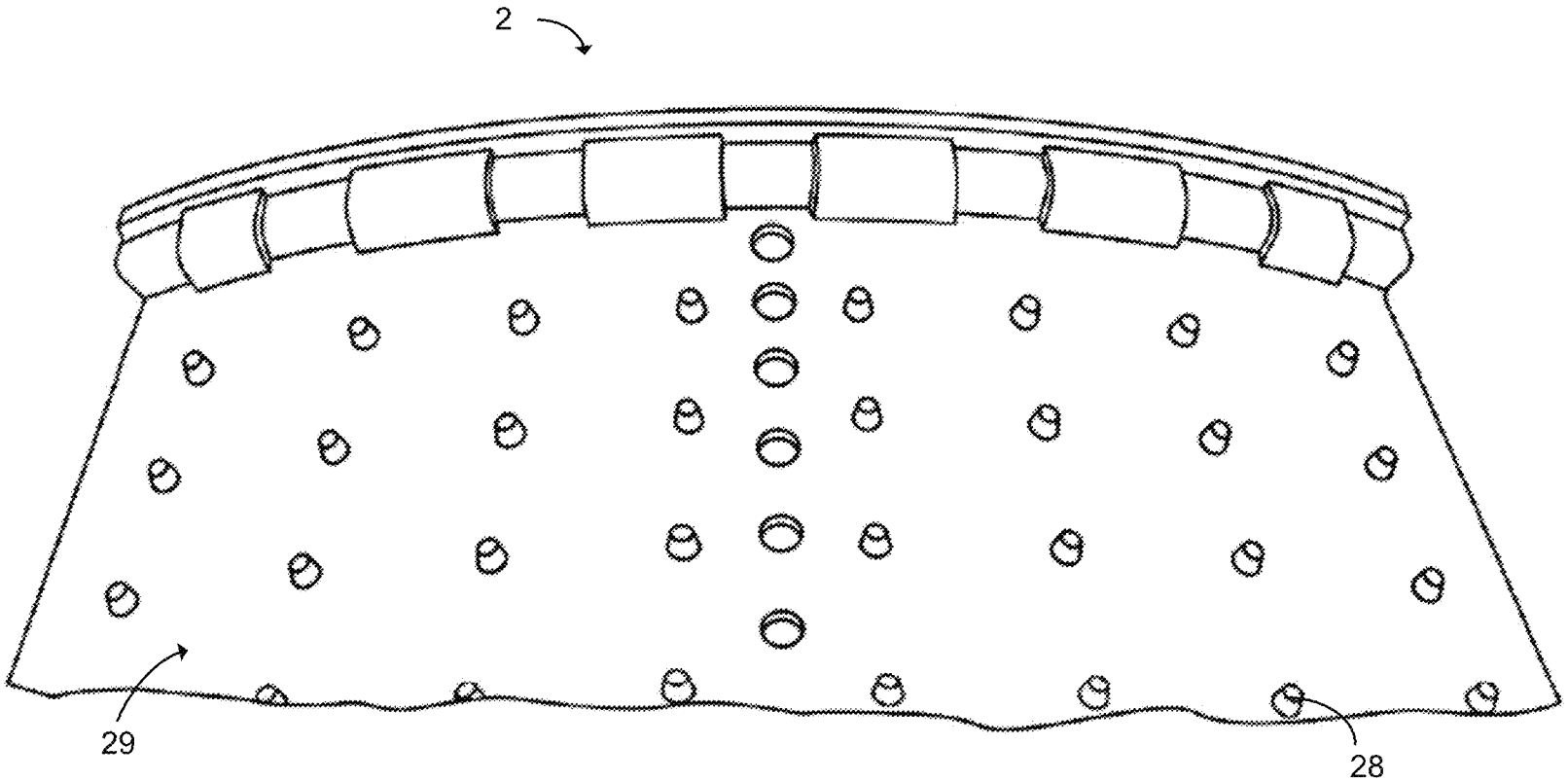
FIG. 19 is an elevation view depicting the multiple conical projections on the interior of the front of the wall segment.

These wall segments 2 adjoin or connect to one another to form, when viewed from above, a wall 1 which is either (1) a closed FIG. 3 such as a polygon or, preferably, a circle or a wall 1 the ends 4 of which do not join.

When viewed from the front 5 (i.e., the portion of the wall segment 2 which faces outward, in the version where the wall 1 creates a closed FIG. 3) or viewed from the back 6 (i.e., the portion of the wall segment 2 which is directed inward when the wall 1 creates a closed FIG. 3), the wall segments 2 appears to be a rectangle. When viewed from the top 7 or the bottom 8, the wall segments 2 preferably appear to be an arc of a circle but optionally appear to be a rectangle.

However, similarly to a wall segment 2 which appears to be an arc of a circle when viewed from above, the first end 9 and the second end 10 of a wall segment 2 which otherwise appears to be a rectangle when viewed from above, such first end 9 and, preferably, the second end 10 of at least one of two adjacent otherwise rectangular wall segments 2 must be angled with respect to one another, not parallel to one another, when such wall segments 2 are to be used to form a polygon that is not, itself, a rectangle.

Near or on the first end 9 of a wall segment 2 and near or on the second end 10 of a wall segment 2 is a component 11 of a connector 12 so that multiple wall segments 2 can be connected to form the closed FIG. 3 or wall 1 the ends 4 of which are not joined, although when the ends 4 of the wall 1 are not joined, the first end 9 of the first wall segment 2 does not require a component 11 of a connector 12 and the second end 10 of the last wall segment 2 does not require a component 11 of a connector 12.

The first component 13 of a connector 12 used for a closed FIG. 3 other than a rectangle will preferably be on a second end 10 of a wall segment 2, and the mating or second component 14 of the connector 12 will preferably be on the first end 9 of the adjacent wall segment 2. This will also be true for wall segments 2 forming a rectangle except for wall segments 2 which create a corner 15 of the rectangle.

At any corner 15 of a rectangle there must, however, be a first component 13 of a connector 12 and a mating or second component 14 of a connector 12. And, preferably, the alternating pattern of first and second components 13, 14 of connectors 12 continues.

When a rectangular closed figure has only four wall segments 2, though, the only other binding restraint is that for both wall segments 2 which are parallel to one another both components 11 of the connector 12 must be in the same type of location on the respective wall segment 2, i.e., either on the inward facing back 5 or on an end 9, 10, although the type of component 11 of a connector 12 (first 13 or mating 14) at any such location need not necessarily be identical for each parallel wall segment 2. See, e.g., Figure x through Figure y.*

Preferably, the first component 13 of a connector 12 is a projection 13 (a male component 13); and the mating or second component 14 of a connector 12 is an aperture 14 (a female component 14). Even more preferably, the connector 12 is a tongue and groove connector 12 with the first component 13 of the connector 12, consequently, being a tongue 13 and with the mating or second component of the connector, consequently, being a groove 14. If desired, more than one connector 12 can be used to join adjacent wall segments 2. Most preferably, though, the first component 13 of the connector 12 is an elongate projection in at least two—but, preferably, three—directions such as an extended tongue of a tongue and groove connector and the second component 14 of the mating aperture 13 is an elongate aperture in at least two—but, preferably, three—directions such as an extended-groove 14 of a tongue and groove connector 12; indeed, the extended tongue 13 and an extended groove 14 are most preferably of such a size as to cause adjacent wall segments 2 to move substantially together in addition to aligning such wall segments 2 thereby enhancing the stability of a wall formed from such wall segments 2 and maintaining the integrity of such wall.

When desired, the connection of the wall segments 2 can be reinforced by placing a supplemental fastener, preferably a screw (especially a self-tapping screw) or bolt through one or more of the front and back of the wall segment 2 and also through the tongue 13 of the tongue and groove connector 12.

For a wall segment 2 which is intended for use with a trampoline, a channel 16 preferably exists along the length of each wall segment 2 at the top 7 of the back 6 of the wall segment 2 when such wall segment 2 is intended to be used in conjunction with a trampoline.

Also preferably for a wall segment 2 which is intended to be used in conjunction with a trampoline the deepest portion 17 of the channel 16 has the same shape as the surface of a trampoline ring. As mentioned above, the channel 16 for use with a trampoline keeps the trampoline in better contact with the wall and thereby reduces the risk of a gap between the trampoline and the wall which could cause an injury to the user of the trampoline.

And also a channel 16 intended to be used with a trampoline, preferably, has at least one depression 18, termed "air vent depression" 18 extending from the back 6 of the wall segment 2 to the top 7 of the wall segment 2 (to permit air forced down by a user landing on the trampoline to escape and then to permit air to be drawn back under the trampoline as the user is rebounded upward).

In lieu of the above-described air vent depression 18, there are options for providing air venting, e.g., either (a) one or more apertures 22 in the back 6 of the wall segment below 2 the channel 16 and one or more apertures (not illustrated) in the top 7 of the wall segment 2 when the wall segment 2 is hollow (which is preferred) or (b) one or more tunnels (not illustrated) extending from the back 6 of the wall segment 2 to the top of the wall segment 2 when the wall segment 2 is solid.

The wall segment 2 is composed of plastic, most preferably polyethylene, which can formed by rotational molding (which is also termed rotomolding) but can optionally be composed of wood, metal, or fiberglass or the like or any material known by a person of ordinary skill in the art to be acceptable.

Also optionally, if a solid wall segment 2 is desired, it can be so formed from the preceding materials or a hollow wall segment 2 can be filled with any high-density foam which dries and is known to one of ordinary skill in the art to be acceptable.

Even more preferably, as explained above, a segment of a trampoline ring 19 is situated in the channel 16 and is, preferably, attached to the top 20 of a leg 21 preferably composed of metal, which is preferably embedded in each such wall segment 2, although optionally some wall segments 2 do not contain the leg 21, and which can serve as a trampoline leg. Preferably, adjacent ring segments 19, which are preferably made of metal and which are preferably hollow, are connected to one another; also, preferably the adjacent ring segments 19 can be connected simultaneously or nearly simultaneously with the connection of the adjacent wall segments 2. Preferably, this is accomplished having a first end 22 of the ring segment 19 near, or most preferably, aligned with the first end 9 of the associated wall segment 2 and by having the second end 23 of the ring segment 19 extend beyond the second end 10 of the associated wall segment 2 and, having the diameter 24 of the second end 23 of the ring segment 19 decrease where the ring segment 19 passes the second end 10 of the associated wall segment 2 sufficiently to fit into the first end of the ring segment 19 associated with the next wall segment 2 with no gaps between the adjacent wall segments 2. However, any connector known to one of ordinary skill in the art can be utilized to connect the adjacent ring segments 19.

For a wall segment 2 not intended to be used with a trampoline, there is not necessarily, but preferably, a channel 16; and, also preferably, an elongate member 25, which is preferably metal and is also preferably hollow, is connected to the top 7 of each wall segment 2. Moreover, preferably, the elongate members 25 for each wall segment 2 are connected to each other; also, preferably the adjacent elongate members 25 can be connected simultaneously or nearly simultaneously with the connection of the adjacent wall segments 2 just as described above for wall segments 2 associated with a trampoline, i.e., a second end 26 of the elongate member 25 would have a smaller cross section than the first end 27 of the elongate member 25 so that the second end 26 of one elongate member 25 could fit into the first end 27 of an adjacent elongate member 25. And the elongate member 25 for each wall segment 2 is, even more preferably, connected to the wall segment 2 by being connected to a leg 21, which is preferably embedded in the wall segment 2. Most preferably, the elongate members 25 of adjacent wall segments 2 can be connected with one another simultaneously or nearly simultaneously with the connection of the mating portions 13, 14 of the connectors 12 for the adjacent wall segments 2.

As indicated above, the wall segments 2 are preferably hollow to decrease their weight; but the wall segments 2 also preferably have inward projections 28 from the interior 29 of the front 5 of the wall segment 2 touching inward projections 30 from the interior 31 of the back 6 of the wall segment 2 to increase the strength of the wall segments 2 while maintaining the light weight of the wall segments 2. Preferably, multiple conical projections 28 on the interior 29 of the front 5 of the wall segment 2 touch multiple semi-cylindrical projections 30 on the interior 31 of the back 6 of the wall segment 2 to increase the structural strength of the wall segment 2 while maintaining reduced weight for the wall segment 2.

Preferably, the wall segments 2 used for any purpose each have a leg 20, as discussed above, embedded within them to increase stability and structural strength, whether the wall segment 2 is to be used with a trampoline or not. The leg 21 is attached to a ring segment 19 when the wall segment 2 is associated with a trampoline and connected to an elongate member 25 for a wall segment 2 not intended to be used with a trampoline. Inward projections 32 designated leg retainers 32 from the interior 29 of the front 5 of the wall segment 2 and from the interior 31 of the back 6 retain the imbedded leg 21 within the wall segment 2 thereby both increasing the strength of the wall segment 2 and maintaining the light weight of the wall segment 2. Furthermore, as does the channel 16 as described above, the leg 21 keeps a trampoline in better contact with the wall segment 2 and thereby reduces the risk of a gap between the trampoline and the wall 2 which could cause an injury to the user of the trampoline.

Additionally, the end 33 of the leg retainers 32 away from the front 5 or back 6 of the wall segment 2 is shaped to accommodate the leg 21. Also, each leg retainer 32 is preferably hollow. The imbedded leg 21, therefore, both increases the strength of the wall segment 2 and maintains the light weight of the wall segment 2.

Optionally. A planar plate 34 is attached at the bottom 35 of the leg 21 parallel to the bottom 8 of the wall segment 2.

For a wall segment 2 which is intended to be buried in the ground with the top 7 of the wall segment 2 level with the ground, such as for use with a trampoline, a horizontal ledge 36 preferably extends outward from the top 7 front of the wall segment 2 along the length of the wall segment 2 to serve as a support, designated a mow strip 36, for a lawnmower or trimmer to care for grass adjacent to the wall segment 2 without damaging any portion of the trampoline or any other object near the back of the wall segment 2. This mow strip 36, furthermore and even if no grass is adjacent to the Modular Wall reduces the risk of having a potentially dangerous gap between the ground and the wall segment 2.

The ring segments 19 for use with a trampoline include the apertures traditionally known in the art for connecting a spring from the jumping mat of the trampoline to the ring segments 19.

Several options exist for using the Wall Modules to construct a Modular Wall associated with a trampoline and are discussed immediately below.

The ring segments 19 must either be connected to each other or to the adjacent wall segment 2.

If the ring segments 19 are connected to each other, then the wall segments 2 do not have to be connected together because the ring segments 19 won't be dislodged by an inward force or an outward rebound.

But if the ring segments 19 aren't connected to each other, then each ring segment 19 must be connected to the adjacent wall segment 2; and the wall segments 2 must either be connected to each other or, for non-rectangular walls, the wall segments must be at least partially below ground and have their fronts 5 adjacent to the soil.

Non-rectangular wall segments 2 (for polygons other than rectangles and for circles) cannot be separated from each other by an inward force when each wall segment is connected to the adjacent ring segment because the length of the back 6 (inside wall) of each such wall segment 2 is shorter than the length of the face 5 (outside wall) for that wall segment 2, similarly to the walls of a traditional igloo. Therefore, for every point along the ends of a wall segment 2, the ends 9, 10 of the adjacent segment 2 block any inward movement of the wall segment 2.

A Modular Wall constructed with the Wall Modules can be built with the bottom 8 of the wall segments 2 on the ground, below the ground, or on a floor.

A Modular Wall composed of eight Wall Modules for association with a trampoline can be can be assembled in three to four minutes and permits nesting (stacking) of the Wall Modules. By reversing the direction of every other Wall Module nesting can be accomplished even when the wall segments 2 incorporate a mow strip 36.

Notably, the Modular Wall can be provided as a kit having the Wall Modules.

As used herein, the term "substantially" indicates that one skilled in the art would consider the value modified by such terms to be within acceptable limits for the stated value. Also as used herein the term "preferable" or "preferably" means that a specified element or technique is more acceptable than another but not that such specified element or technique is a necessity.

We claim:

1. A wall module for a modular wall, comprising:

a first curved wall segment comprising a first end and a second end;

a first connector portion comprising an extended tongue on the second end of the first curved wall segment;

a mating portion of a connector comprising an extended groove in the first end of the first curved wall segment, wherein the extended tongue and the extended groove are of such a size as to cause a second curved wall segment when connected with said first curved wall segment to move together with said first curved wall segment;

a first curved channel within the first curved wall segment angled toward a concave side of the first curved wall segment, the first curved channel being continuous along a length of the first curved wall segment and comprising at least two laterally spaced venting depressions; and a ledge portion fixed to the first curved wall segment on a top of the first curved wall segment, the ledge portion extending perpendicular to and laterally beyond a convex side of the first curved wall segment and configured to rest against and above a ground surface such that the ledge portion is exposed when the first curved wall segment is placed in the ground.

2. The wall module of claim 1, wherein the first curved channel is curved in a first plane parallel to the ledge portion and in a second plane perpendicular to the first plane.

3. The wall module of claim 1, wherein the first curved wall segment comprises at least one of the following: plastic, wood, metal, fiberglass, or any combination thereof.

4. The wall module of claim 1, wherein the first curved wall segment comprises a hollow interior.

5. The wall module of claim 1, the first curved wall segment comprising one or more apertures extending through a thickness of the first curved wall segment, wherein the one or more apertures are positioned substantially collinearly with one another.

6. A wall module for a modular wall, comprising:

a first curved wall segment comprising a first end and a second end;

a first connector portion comprising an extended tongue on the second end;

a mating portion of a connector comprising an extended groove in the first end of the first curved wall segment, wherein the extended tongue and the extended groove are of such a size as to cause a second curved wall segment when connected with said first curved wall segment to move together with said first curved wall segment;

a ledge portion fixed to the first curved wall segment on a top of the first curved wall segment, the ledge portion extending perpendicular to and laterally beyond a convex side of the first curved wall segment and configured to rest against and above a ground surface such that the ledge portion is exposed when the first curved wall segment is placed in the ground; and a curved channel extending from the first end to the second end, the curved channel being continuous along a length of the first curved wall segment and comprising at least two laterally spaced venting depressions.

7. The wall module of claim 6, wherein the ledge portion does not extend laterally beyond a concave side of the first curved wall segment.

8. The wall module of claim 6, wherein the ledge portion extends laterally beyond any additional ledge portion of the first curved wall segment.

9. The wall module of claim 6, wherein the first curved wall segment comprises a polyethylene material.

10. The wall module of claim 6, wherein at least one of the at least two venting depressions is transverse across a portion of the curved channel and has a width in a plane parallel to the ledge that is greater than a width of the curved channel.

11. A retention wall system, comprising:

a plurality of curved wall segments, the plurality of curved wall segments comprising at least a first curved wall segment and a second curved wall segment comprising:

a first connector portion comprising an extended tongue on a second end of the first curved wall segment;

a mating portion of a connector comprising an extended groove in a first end of the first curved wall segment, wherein the extended tongue and the extended groove are of such a size as to cause the second curved wall segment when connected with the first curved wall segment to move together with the first curved wall segment;

a first curved channel within the first curved wall segment angled toward a concave side and configured to receive a portion of a ring, the first curved channel being continuous along a length of the first curved wall segment and comprising at least two laterally spaced venting depressions; and a ledge portion fixed to the first curved wall segment on a top of the first curved wall segment and extending substantially perpendicular to and laterally beyond a convex side of the first curved wall segment, and configured to rest against and above a ground surface such that the ledge portion is exposed when the first curved wall segment is placed in the ground.

12. The system of claim 11, wherein the second curved wall segment comprises a second curved channel.

13. The system of claim 12, wherein the second curved channel is configured to be substantially aligned with the first curved channel when the second curved wall segment is connected to the first curved wall segment.

14. The system of claim 13, further comprising:

the ring within the first curved channel; and a trampoline comprising a leg positioned substantially perpendicular to the ring and embedded in the first curved wall segment.

15. The system of claim 11, further comprising a third channel positioned substantially perpendicular to the ring and configured to receive a portion of the trampoline leg.

16. The system of claim 11, wherein the first curved channel is to fit around a portion of a circumference of the ring.

17. The system of claim 11, wherein:

each curved wall segment of the plurality of curved wall segments is configured to be connected to another curved wall segment of the plurality of curved wall segments; and the plurality of curved wall segments are configured to form a closed circle when each curved wall segment of the plurality of curved wall segments is connected to another curved wall segment of the plurality of curved wall segments.

18. The system of claim 11, further comprising a trampoline, the trampoline comprising the ring.

19. The wall module of claim 11, wherein the ledge extends horizontally beyond a remainder of the system.

20. The system of claim 11, wherein a shape of a surface of the ring matches a shape of the first curved channel.

* * * * *